US010793315B2

(12) United States Patent
Taylor et al.

(10) Patent No.: US 10,793,315 B2
(45) Date of Patent: Oct. 6, 2020

(54) CUSTOM PACKAGING CENTER AND PACKAGING FOR USE IN THE CUSTOM PACKAGING CENTER

(71) Applicant: NESTEC SA, Vevey (CH)

(72) Inventors: Curtis Taylor, Chagrin Falls, OH (US); Aaron Misener, Chagrin Falls, OH (US)

(73) Assignee: SOCIÉTÉ DES PRODUITS NESTLÉ S.A., Vevey (CH)

( * ) Notice: Subject to any disclaimer, the term of this patent is extended or adjusted under 35 U.S.C. 154(b) by 762 days.

(21) Appl. No.: 14/174,953

(22) Filed: Feb. 7, 2014

(65) Prior Publication Data

US 2014/0230371 A1 Aug. 21, 2014

Related U.S. Application Data

(60) Provisional application No. 61/766,143, filed on Feb. 19, 2013.

(51) Int. Cl.

| | |
|---|---|
| ***B65D 5/42*** | (2006.01) |
| ***B65B 61/26*** | (2006.01) |
| ***B65B 57/14*** | (2006.01) |
| ***B65D 5/02*** | (2006.01) |
| ***B65B 5/06*** | (2006.01) |
| ***B65D 5/54*** | (2006.01) |

(52) U.S. Cl.

CPC ..... *B65D 5/4279* (2013.01); *B65B 5/06* (2013.01); *B65B 57/14* (2013.01); *B65B 61/26* (2013.01); *B65D 5/0254* (2013.01); *B65D 5/542* (2013.01); *B65B 2210/04* (2013.01)

(58) Field of Classification Search

CPC ..... B65B 65/08; B65B 5/00; B65B 61/26; B65B 5/06; B65B 5/08; B65B 5/10; B65B 5/101; B65B 57/00; B65B 57/10; B65B 57/14; B65B 35/00; B65B 35/30; B65B 35/58; B65B 25/00; A47F 9/047; A47F 9/048; A47F 10/02; B65D 5/4279

USPC ..... 53/411, 131.2, 167, 443, 507, 493, 53/498–500, 52; 229/125.33; 235/462.14, 383; 186/61, 66

See application file for complete search history.

(56) References Cited

U.S. PATENT DOCUMENTS

| | | | | |
|---|---|---|---|---|
| 3,077,950 A * | 2/1963 | Brown | ..... | A47F 9/043 186/66 |
| 4,084,742 A * | 4/1978 | Silverman | ..... | A47F 9/046 101/41 |
| 4,248,389 A | 2/1981 | Thompson et al. | | |

(Continued)

FOREIGN PATENT DOCUMENTS

| | | |
|---|---|---|
| CN | 101515390 | 8/2009 |
| EP | 0614834 A1 | 9/1994 |

(Continued)

OTHER PUBLICATIONS

U.S. Search Authority, International Search Report and Written Opinion issued for corresponding PCT App. No. PCT/US2014/015193 (dated Jul. 18, 2014).

(Continued)

*Primary Examiner* — Dariush Seif

(57) ABSTRACT

A custom packaging center for custom selecting and custom packaging canned and/or container goods and a novel box for use with the custom packaging center.

14 Claims, 22 Drawing Sheets

(56) References Cited

U.S. PATENT DOCUMENTS 4,707,251 A * 11/1987 Jenkins ..... B07C 5/365 198/416
4,929,819 A * 5/1990 Collins, Jr. ..... A47F 9/047 235/383
4,964,053 A * 10/1990 Humble ..... A47F 9/048 186/61
5,083,638 A 1/1992 Schneider
5,239,167 A * 8/1993 Kipp ..... A47F 9/046 235/375
5,437,346 A * 8/1995 Dumont ..... A47F 9/042 186/61
5,525,786 A 6/1996 Dumont
5,551,531 A * 9/1996 Dumont ..... A47F 9/042 186/61
5,641,039 A * 6/1997 Dumont ..... A47F 9/042 186/61
6,370,844 B1 * 4/2002 Stricker ..... B65B 35/58 53/427
6,766,948 B1 * 7/2004 Burns ..... B65B 1/32 235/383
6,990,463 B2 * 1/2006 Walter ..... A47F 9/046 235/383
7,044,370 B2 * 5/2006 Bellis, Jr. ..... A47F 9/047 235/383
7,146,784 B1 * 12/2006 Portrait ..... B65B 5/024 53/544
7,229,015 B2 * 6/2007 Persky ..... G06Q 20/20 186/61
7,780,085 B2 * 8/2010 LaRue ..... H04N 1/00795 235/454
8,056,305 B1 * 11/2011 Folk ..... G07D 11/0084 53/399
8,239,268 B2 * 8/2012 Iizaka ..... G06Q 20/201 235/375
8,825,531 B1 * 9/2014 Catoe ..... G07G 1/0036 235/383
8,944,324 B2 * 2/2015 Iizaka ..... G07G 1/0045 235/383
9,022,281 B2 * 5/2015 Hasegawa ..... G06Q 20/208 235/375
2006/0038009 A1 * 2/2006 Russell ..... A47F 9/04 235/383
2009/0134221 A1 * 5/2009 Zhu ..... G06K 7/10544 235/383
2010/0127077 A1 * 5/2010 Ueda ..... G07F 9/02 235/383
2010/0200656 A1 * 8/2010 Marshall ..... G07G 1/0036 235/383
2011/0048859 A1 * 3/2011 Ellis ..... A47F 9/042 186/66
2011/0089234 A1 * 4/2011 Iida ..... G07G 1/0054 235/383
2011/0259952 A1 * 10/2011 Yamada ..... A47F 9/047 235/375
2013/0015242 A1 * 1/2013 White ..... G06K 7/10554 235/383
2013/0153655 A1 * 6/2013 Dawkins ..... G07G 1/0045 235/383
2013/0175339 A1 * 7/2013 Svetal ..... G06Q 30/06 235/383
2013/0254044 A1 * 9/2013 Catoe ..... G06Q 20/20 705/16
2013/0256041 A1 * 10/2013 Collins, Jr. ..... G01G 19/4144 177/2
2013/0313316 A1 * 11/2013 Jones ..... G06Q 20/204 235/383
2013/0320083 A1 * 12/2013 Hammer ..... A47F 9/046 235/383
2014/0346227 A1 * 11/2014 Takane ..... G07G 1/0054 235/383
2019/0283909 A1 * 9/2019 Amemura ..... B65B 57/04

FOREIGN PATENT DOCUMENTS

| | | | |
|---|---|---|---|
| EP | 0327514 | A2 | 8/1998 |
| GB | 2338100 | | 8/1999 |
| JP | S51132995 | U | 10/1976 |
| JP | 6058357 | A | 4/1985 |
| JP | 6-87303 | | 12/1994 |
| JP | 10-031714 | A | 2/1998 |
| JP | 2003-051067 | | 2/2003 |
| JP | 2007-253984 | A2 | 10/2007 |
| JP | 2008276539 | A | 11/2008 |
| JP | 2012531371 | A | 12/2012 |
| WO | 199965000 | A1 | 12/1999 |
| WO | 2012146942 | A2 | 11/2012 |

OTHER PUBLICATIONS

European Opinion and Supplementary European Search Report dated Mar. 16, 2016 for EP application No. 14754244.

* cited by examiner

CUSTOM PACKAGING CENTER AND PACKAGING FOR USE IN THE CUSTOM PACKAGING CENTER

The present provisional application claims priority on U.S. Provisional Application Ser. No. 61/766,143 filed Feb. 19, 2013, which is incorporated by reference.

The present invention is directed to a custom packaging center. The invention is particularly applicable to the custom packaging of canned items and will be described with particular reference thereto; however, it will be appreciated that the invention has much broader applications and can be used to custom package other types of goods (e.g., pet food, canned soup, canned meat, canned seafood, canned fruit, canned vegetables, containers of mints/breath fresheners, containers of gum, containers of candy, beverage containers, spice containers, frozen beverage concentrates containers, containers of yogurt, containers of refrigerated or frozen bakery goods, containers of ice cream or sorbet, votive candles, etc.).

BACKGROUND OF THE INVENTION

Grocery stores and other retail stores commonly provide a variety of choices for certain types of items. For instance, canned pet food from a particular supplier is commonly offered in a variety of flavors. As such, it is not uncommon for an individual to purchase several different flavors of pet food during a shopping visit at a store. During checkout, each of the canned pet food items needs to be individually scanned and is then placed in a bag at checkout. Commonly, the pet food cans are intermixed with other items during the bagging process at the store. The time and labor to scan and bag many differently flavored pet food containers can result in slower checkout times at the checkout counter. Also, it is not uncommon for the checkout clerk to scan a single can of pet food and then repeat this same entry for the other cans of pet food. Although this can result in reduced checkout times, scanning a single can to be representative of different flavored pet food results in improper inventory control of the pet food items at the store. The intermixing of the pet food cans with other food items increases the sorting time required by the purchasers to put away the purchased items at home. These problems also can exist with other food items that are commonly offered with a variety of different flavors (e.g., soups, yogurt, canned vegetables, etc.).

In view of the current manner in which similar type and/or brand of food items are offered in a variety of flavors are selected, checked out, bagged and sorted, there is a need for a more efficient way to check out and package similar type and/or brand of food items that are purchased and taken home by the consumer.

SUMMARY OF THE INVENTION

The present invention is directed to a custom packing center that addresses the deficiencies of checking out and packaging similar types and/or brands of food items that are purchased and taken home by the consumer. The invention is particularly applicable to the custom packaging of canned pet food and will be described with particular reference thereto; however, it will be appreciated that the invention has much broader applications and can be used to custom package other types of canned goods or goods in a container (e.g., soup containers [e.g, canned soup, etc.], meat containers [e.g., canned meat, etc.], seafood container [e.g., canned tuna, canned salmon, etc.], fruit containers [e.g., canned pears, canned fruit cocktail, etc.], canned vegetables, containers of sauces [e.g., canned tomato sauce, canned tomato paste, canned spaghetti sauce, etc.], containers of mints/breath fresheners, containers of gum, containers of candy, beverage containers [e.g., cans or bottles of Coke® products, bottled water, etc.), spice containers, frozen beverage concentrates containers, containers of yogurt, containers of refrigerated or frozen bakery goods, containers of ice cream or sorbet, etc.). The canned goods or goods in the container can be in a metal, plastic, paper, etc. can or container. The shape, configuration and size of the can or container are non-limiting.

The custom packaging center of the present invention is designed to allow a customer to select several items of a particular brand of canned pet food and to package the selected items in a single package. The single package optionally includes information (e.g., bar code, etc.) that identifies each item in the single packaging. As such, the single package reduces the scanning time and packaging time during checkout, and also reduces the sorting time of pet food when the customer is putting away purchased items since the purchased pet food items are already together in a single package. The custom packaging center of the present invention has the advantage over bulk prepackaged pet food cans in that the customer is able to customize the quantity for each flavor of the pet food. Typically, bulk prepackaged pet food cans are packaged as a single flavor or packaged in equal quantities of several flavors (e.g., a 24-container package includes six cans for each of the four flavors in the package, etc.). As any pet owner knows, a pet generally prefers one flavor over others. As such, if a pet owner wanted to purchase 24 cans of pet food and such cans represented different flavors and different quantities for each flavor (e.g., 14 cans of one flavor, eight cans of another flavor, and two cans of another flavor, etc.), the pet owner would not be able to purchase a standard bulk package of the pet food, but would instead be required to place 24 cans of the selected pet food in the cart and have each can scanned and bagged at checkout. The custom packaging center of the present invention overcomes this problem by allowing the pet owner to select the desired flavor or variety of pet food and have such selection placed in a single package for easy and more convenient checkout. As such, the custom packaging center of the present invention represents a significant advancement in the manner in which a consumer is able to customize the packaging of canned pet food and then conveniently use the packaging to check out of a grocery or retail store. The size, configuration and shape of the custom packaging center of the present invention is non-limiting. The custom packaging center of the present invention can be positioned on or integrated with a shelf system, such as, but not limited to, a shelf system located at a grocery store, discount or big box store (e.g., Walmart, Target, Kmart, etc.). As can be appreciated, the custom packaging center can be designed to be a free-standing system. The free-standing system can optionally be designed to be mobile.

In one non-limiting aspect of the present invention, the custom packaging center is designed to enable a user to custom select and custom package an assortment of flavors of canned cat food such as, but not limited to, Fancy Feast® brand cat food. As can be appreciated, other cat food brands and/or other types of pet food (e.g., dog food, etc.) can be custom packaged by the custom packaging center of the present invention.

In another and/or alternative non-limiting aspect of the present invention, the custom packaging center generally includes one or more loading stations. The loading station is designed to receive one or more item to be packaged by the custom packaging center. In one non-limiting arrangement, the loading station is designed to enable a customer to load 1-20 items at a time (e.g., one item, two items, . . . 19 items, 20 items) or any range within such values. In one non-limiting example, the loading station is designed to enable a customer to load up to six items (e.g., pet food containers, etc.) at a time. The loading station can optionally be designed to require the customer to orient the item a certain way prior to the item being properly loaded in the loading station. For example, some types of pet food containers have a top with a larger radius than the bottom of the container. For such a container, the loading station can be designed such that the top of each container fits into a certain location in the loading station so that some or all of the loaded containers are required to be oriented a certain way in the loading station. As can be appreciated, the loading station can be designed to load other types of containers in a certain way; however, this is not required. The loading station can optionally include a visual diagram that provides information on how to properly load product in the loading station. The loading station can optionally include audible and/or visual indicators (e.g., lights, etc.) to indicate that 1) the product has been properly or improperly loaded into the loading station, 2) the proper amount of product has been loaded into the loading station, and/or 3) the proper type of product has been loaded into the loading station. The size, shape and configuration of the loading station are non-limiting. The location of the loading station on the custom packaging center is non-limiting. The loading station can optionally be movable so as to position the product loaded in the loading station for further processing by the custom packaging center. In one non-limiting arrangement, the loading station can be rotated to cause the loading station to move from a loading position to a non-load position such that the product is moved to and/or is now in the processing position for further processing by the custom packaging center. The loading station, when rotatable, can be manually and/or automatically operated. In one non-limiting arrangement, the loading station can be rotated at 45°-360° so as to secure the product in the loading station and thereby prevent product in the loading station from being removed from the loading station; however, this is not require. The loading station can be designed to not rotate until the loading station is fully and properly loaded with product; however, this is not required. In another non-limiting arrangement, the custom packaging center includes a closing cover that is used to partially or fully cover product that is loaded in the loading station; however, this is not required. The closing cover, when used, can be manually and/or automatically operated. In one non-limiting arrangement, the closing cover at least partially or fully covers the product that is loaded in the loading station so as to secure the product in the loading station and thereby prevent product in the loading station from being removed from the loading station; however, this is not require. The closing cover can be designed to not close until the loading station is fully and properly loaded with product; however, this is not required. After the closing cover is closed, the product in the loading station is moved to and/or is now in the processing position for further processing by the custom packaging center.

In still another and/or alternative non-limiting aspect of the present invention, the custom packaging center generally includes one or more packaging stations. The packaging station is designed to receive packaging that is used to receive the selected items by the customer. The size, shape and configuration of the packaging station are non-limiting. The location of the packaging station on the custom packaging center is non-limiting. The packaging station is generally designed to allow a customer to remove the package that is partially or fully filled with the selected items; however, this is not required. The packaging station is also generally designed to allow a customer to insert the package into the packaging station so that the packaging can receive the selected items; however, this is not required. In one non-limiting arrangement, the packaging station includes a box tray that is designed to receive packaging that is used to receive the selected items by the customer; however, this is not required. The box tray, when used, is not limited to any size, shape or configuration. The box tray can be designed to be movable between a load/remove position and a fill position; however, this is not required. The load/remove position allows the packaging to be loaded into the box tray prior to being loaded with product and to allow the packaging to be removed from the box tray after the packaging has been loaded with product. The fill position orients the packaging in the box tray to receive product that has been processed by the custom packaging center. Generally, the packaging in the box tray cannot be removed from the box tray when the box tray is in the fill position; however, this is not required. In one non-limiting example, the box tray is designed to be pivotable between the load/remove position and the fill position; however, this is not required. The movement of the box tray between the load/remove position and the fill position can be manual and/or automatic.

In yet another and/or alternative non-limiting aspect of the present invention, the custom packaging center generally includes an item identification arrangement to identify the one or more items that were loaded in the loading station; however, this is not required. The identification arrangement, when used, can be used to facilitate in inventory control of items purchased by a consumer; however, this is not required. In one non-limiting example, the identification arrangement can store information (e.g., hard disk storage, flash drive storage, etc.) that can be downloaded and/or send information (e.g., wire transmissions, wireless transmission, etc.) to a processing unit (e.g., computer, printer, email system, etc.) that can be used by a grocery store, retail store, etc. to track the sale and/or inventory of items that are processed by the custom packaging center. In another and/or alternative non-limiting example, the identification arrangement can include a product detector and/or scanner (e.g. bar code scanner, rfid reader/detector, etc.). The product detector and/or scanner, when used, can be used to identify the one or more products that were placed in the loading station and/or processed through the custom packaging center so as to keep track of the products that are packaged in the packaging. The size, shape, configuration, type and location of the product detector on the custom packaging center are non-limiting. In still another and/or alternative non-limiting example, the identification arrangement can include an orientation/movement system used to move and/or orient the product relative to the product detector to facilitate in the identification/scanning of the product by the product detector; however, this is not required. In one non-limiting arrangement, the orientation/movement system, when used, can include a rotating mechanism that causes the product to rotate. For instance, when the product detector includes a bar code scanner, the bar code on the product may not be aligned with the scanner when placed in the loading station and/or moved to a scanning location in the custom packaging center. The rotating mechanism can be used to rotate the product such that the bar code on the product passes/moves by the detection zone of the bar code scanner so that the bar code scanner can detect the bar code on the product. As can be appreciated, the type, shape and configuration of the orientation/movement system are non-limiting. In one non-limiting example, when the product that was loaded in the loading station is in or moved to the processing position, the product is in the processing position contacts or can be contacted by the rotating mechanism; however, this is not required. In yet another and/or alternative non-limiting example, the identification arrangement can include a printer that prints out a label and/or applies a label, bar code and/or other information to the packaging that can be used at check-out to identify the items in the packaging; however, this is not required. In one non-limiting example, the identification arrangement includes a label printer that prints information on a label (e.g., bar code, item list, etc.) that can be printed out so a customer can apply the label to the packaging and/or can be automatically applied by the custom packaging center to the packaging. In another and/or alternative non-limiting example, the identification arrangement includes a printer that prints information (e.g., ink printing, thermal printing, pressure printing, etc.) onto the packaging. When the custom packaging center automatically applies information to the packaging, the information is generally applied prior to the packaging being removed from the packaging station; however, this is not required. When the custom packaging center prints out a label for the customer to apply to the packaging, the location of the printer and/or the label dispenser on the custom packaging center is non-limiting.

In still yet another and/or alternative non-limiting aspect of the present invention, the custom packaging center can include one or more monitors and/or interactive screens; however, this is not required. The monitor and/or interactive screen, when used, can be used to 1) provide information about the custom packaging center, 2) provide instructions on how to use the custom packaging center, 3) provide information about the products that have been loaded by the customer into the custom packaging center, 4) provide information about the pricing of the products that have been loaded by the customer into the custom packaging center, 5) provide status information to the customer during the loading process of the product into the packaging, 6) provide advertising about products, brands and/or store promotions, etc., 7) enable the customer to select coupons, enter discount codes and/or scan coupons for products to be packaged by the custom packaging center, 8) provide information to guide the customer during the steps of use of the custom packaging center, 9) start the process for using the custom packaging center, 10) notify the customer that the products have been properly and/or improperly loaded in the loading station, 11) cause the loading station to rotate and/or the closing cover to close after product has been loaded into the loading station, 12) notify the customer that the packing process has been completed, 13) cause a label to be printed on a label and/or onto the packaging, 14) cancel the packaging process, 15) provide error information regarding the custom packaging center, 16) provide error information when the packaging receptacle is empty, 17) cause the box tray of the packaging station to open and/or close, 18) enable a user to obtain information about the cat food (e.g., nutrition information, etc.), and/or 19) provide error information to a customer during the use of the custom packaging center. As can be appreciated, the monitor and/or interactive screen can be used to provide other or additional information to a customer (e.g., price information, whether a flavor is unavailable, provide coupons, provide pricing specials, provide promotional information, provide audio sounds and/or video information, etc.). As can be appreciated, the types of information, the manner of presenting the information to the user, and the manner in which the user accesses and/or interfaces with the selection panel are non-limiting. The size, shape, configuration and/or location of the monitor and/or interactive screen on the custom packaging center are non-limiting. The monitor and/or interactive screen can be designed to interact with a scanner on a mobile device, etc.; however, this is not required. The monitor and/or interactive screen can may or may not be a touch screen. For example, the monitor and/or interactive screen may include a video screen, but includes one or more buttons, knobs, switches, etc. that are used by the user to make a selection and/or to view information on the video screen; however, this is not required. As can be appreciated, the monitor and/or interactive screen can be completely absent a video screen or other type of electronic display; however, this is not required. As can also be appreciated, the monitor and/or interactive screen can be voice interactive, mobile device interactive, etc.; however, this is not required.

In another and/or alternative non-limiting aspect of the present invention, the custom packaging center can include a product transport arrangement that is used to move the product on the loading station into the packaging located in the packaging station; however, this is not required. The transport arrangement can use gravity, motors, conveyor systems, guide rails, guide shoots/slots and the like to guide and/or move the product from the loading station into the packaging. In one non-limiting arrangement, there is provided a moveable panel or door in the bottom portion of the loading station and/or below the loading station. When the moveable panel or door is in the open position, gravity causes the one or more products in the loading station to fall past the open panel or door and to fall into the packaging in the packaging station. A manual system and/or automated system can be used to control the opening and closing of the panel or door. In one non-limiting arrangement, the panel or door is opened after the product detector detects the products in the loading station and thereafter closes when the products drop into the packaging; however, this is not required.

In still another and/or alternative non-limiting aspect of the present invention, the custom packaging center can include one or more processing chips, computers, communication devices, storage devices, monitors, displays, motors and/or power sources to operate and/or power one or more components of the custom packaging center; however, this is not required.

In yet another and/or alternative non-limiting aspect of the present invention, the custom packaging center can include a packaging bin that is designed to contain the packaging that is used in the custom packaging center; however, this is not required. Generally, the packaging bin is designed to contain a plurality of packaging; however, this is not required. Generally, the packaging in the packaging bin is in a folded form; however, this is not required. The size, shape and configuration of the packaging bin are non-limiting. The location of the packaging bin relative to the custom packaging center is non-limiting.

In still yet another and/or alternative non-limiting aspect of the present invention, the custom packaging center can be mounted in a fixed position or mounted to a mobile unit; however, this is not required.

In another and/or alternative non-limiting aspect of the present invention, the custom packaging center can include or be used with one or more product arrangement trays or retainers; however, this is not required. The product arrangement tray or retainer, when used, allows a customer to select and then place product on the product arrangement tray or retainer prior to loading the product into the loading station of the custom packaging center. As such, the product arrangement tray or retainer allows the customer to preselect the desired flavors of product prior to loading the product into the loading station of the custom packaging center. The size, shape and configuration of the product arrangement tray or retainer are non-limiting.

In still another and/or alternative non-limiting aspect of the present invention, the custom packaging center can use special packaging that is specifically designed for use with the custom packaging center; however, this is not required. In one non-limiting arrangement, the packaging is in the form of a foldable box. The packaging is generally made of a paper, paper board and/or cardboard material; however, other or additional materials can be used (e.g., plastic, metal, etc.). The packaging typically includes a closing arrangement such as an adhesive seal, lock tab, etc.; however, this is not required. The packaging can optionally include a serrated, slotted, grooved, etc. lid portion that can be opened to easily access product in the packaging.

In yet another and/or alternative non-limiting aspect of the present invention, the custom packaging center can optionally include an advertising space for any type of electronic and/or printed advertising.

It is one non-limiting object of the present invention to provide a device that addresses the deficiencies of checking out and packaging similar types and/or brands of items that are purchased and taken home by the consumer.

It is another and/or alternative non-limiting object of the present invention to provide a custom packaging center that is designed to allow a customer to select several items of an item and to package the selected items in a single package.

It is still another and/or alternative non-limiting object of the present invention to provide a custom packaging center that creates a single package that includes information that identifies each item in the single packaging so as to reduce the scanning time and packaging time during checkout, and/or to reduce the sorting time of pet food when the customer is putting away purchased items.

It is yet another and/or alternative non-limiting object of the present invention to provide a custom packaging center that enables a customer to customize the quantity for each flavor of the food product that is packaged in the packaging.

It is still yet another and/or alternative non-limiting object of the present invention to provide a custom packaging center that can be positioned on or integrated with a shelf system, such as, but not limited to, a shelf system located at a grocery store, discount or big box store.

It is another and/or alternative non-limiting object of the present invention to provide a custom packaging center that can be designed to be a free-standing system, which free-standing system can optionally be mobile.

It is still another and/or alternative non-limiting object of the present invention to provide a custom packaging center that includes one or more loading stations designed to receive one or more items to be packaged by the custom packaging center.

It is yet another and/or alternative non-limiting object of the present invention to provide a custom packaging center that includes a loading station designed to require the customer to orient the items in a certain way prior to the item being properly loaded in the loading station.

It is still yet another and/or alternative non-limiting object of the present invention to provide a custom packaging center that includes a loading station having a visual diagram that provides information on how to properly load product in the loading station.

It is another and/or alternative non-limiting object of the present invention to provide a custom packaging center that includes a loading station which has audible and/or visual indicators to indicate that a) product has been properly or improperly loaded into the loading station, b) the proper amount of product has been loaded into the loading station, and/or c) the proper type of product has been loaded into the loading station.

It is still another and/or alternative non-limiting object of the present invention to provide a custom packaging center that includes a loading station which is movable so as to position the product loaded in the loading station for further processing by the custom packaging center.

It is yet another and/or alternative non-limiting object of the present invention to provide a custom packaging center that includes one or more packaging stations designed to receive packaging that is used to receive the selected items by the customer.

It is still yet another and/or alternative non-limiting object of the present invention to provide a custom packaging center that includes a packaging station having a box tray that is designed to receive packaging that is used to receive the selected items by the customer.

It is another and/or alternative non-limiting object of the present invention to provide a custom packaging center that includes a packaging station having a box tray that is designed to be movable between a load/remove position and a fill position.

It is still another and/or alternative non-limiting object of the present invention to provide a custom packaging center that includes an item identification arrangement to identify the one or more items loaded in the loading station.

It is yet another and/or alternative non-limiting object of the present invention to provide a custom packaging center that includes an item identification arrangement that can be used to facilitate in inventory control of items purchased by a consumer.

It is still yet another and/or alternative non-limiting object of the present invention to provide a custom packaging center that includes an item identification arrangement that can store information that can be downloaded and/or send information to a processing unit that can be used by a store to track the sale and/or inventory of items that are processed by the custom packaging center.

It is another and/or alternative non-limiting object of the present invention to provide a custom packaging center that includes an item identification arrangement that includes a product detector and/or scanner to identify the one or more products that were placed in the loading station and/or processed through the custom packaging center.

It is still another and/or alternative non-limiting object of the present invention to provide a custom packaging center that includes an item identification arrangement that includes an orientation/movement system used to move and/or orient the product relative to the product detector to facilitate in the identification/scanning of the product by the product detector.

It is yet another and/or alternative non-limiting object of the present invention to provide a custom packaging center that includes an item identification arrangement that includes a printer that prints out a label and/or applies a label, bar code and/or other information to the packaging that can be used at checkout to identify the items in the packaging.

It is still yet another and/or alternative non-limiting object of the present invention to provide a custom packaging center that includes one or more monitors and/or interactive screens used to 1) provide information about the custom packaging center, 2) provide instructions on how to use the custom packaging center, 3) provide information about the products that have been loaded by the customer into the custom packaging center, 4) provide information about the pricing of the products that have been loaded by the customer into the custom packaging center, 5) provide status information to the customer during the loading process of the product into the packaging, 6) provide advertising about products, brands and/or store promotions, etc., 7) enable customer to select coupons, enter discount codes and/or scan coupons for products to be packaged by the custom packaging center, 8) provide information to guide the customer during the steps of use of the custom packaging center, 9) start the process for using the custom packaging center, 10) notify the customer that the products have been properly and/or improperly loaded in the loading station, 11) cause the loading station to rotate and/or the closing cover to close after product has been loaded into the loading station, 12) notify the customer that the packaging process has been completed, 13) cause a label to be printed on a label and/or onto the packaging, 14) cancel the packaging process, 15) provide error information regarding the custom packaging center, 16) provide error information when the packaging receptacle is empty, 17) cause the box tray of the packaging station to open and/or close, 18) enable a user to obtain information about the cat food (e.g., nutrition information, etc.), and/or 19) provide error information to a customer during the use of the custom packaging center.

It is another and/or alternative non-limiting object of the present invention to provide a custom packaging center that includes a monitor and/or interactive screen used to provide information to a customer (e.g., price information, whether a flavor is unavailable, provide coupons, provide pricing specials, provide promotional information, provide audio sounds and/or video information, etc.).

It is still another and/or alternative non-limiting object of the present invention to provide a custom packaging center that includes a product transport arrangement used to move the product on the loading station into the packaging located in the packaging station.

It is yet another and/or alternative non-limiting object of the present invention to provide a custom packaging center that includes a packaging bin designed to contain the packaging that is used in the custom packaging center.

It is still yet another and/or alternative non-limiting object of the present invention to provide a custom packaging center that is mounted in a fixed position or mounted to a mobile unit.

It is another and/or alternative non-limiting object of the present invention to provide a custom packaging center that includes or can be used with one or more product arrangement trays or retainers that allow a customer to select and then place product on the product arrangement tray or retainer prior to loading the product into the loading station of the custom packaging center.

It is still another and/or alternative non-limiting object of the present invention to provide a custom packaging center that includes special packaging that is specifically designed for use with the custom packaging center.

These and other objects, features and advantages of the present invention will become apparent from the subsequent description taken in conjunction with the accompanying drawings.

BRIEF DESCRIPTION OF THE FIGURES

Reference may now be made to the drawings, which illustrate various non-limiting embodiments that the invention may take in physical form and in certain parts and arrangements of parts wherein.

DETAILED DISCUSSION OF NON-LIMITING EMBODIMENTS

Figure 1:
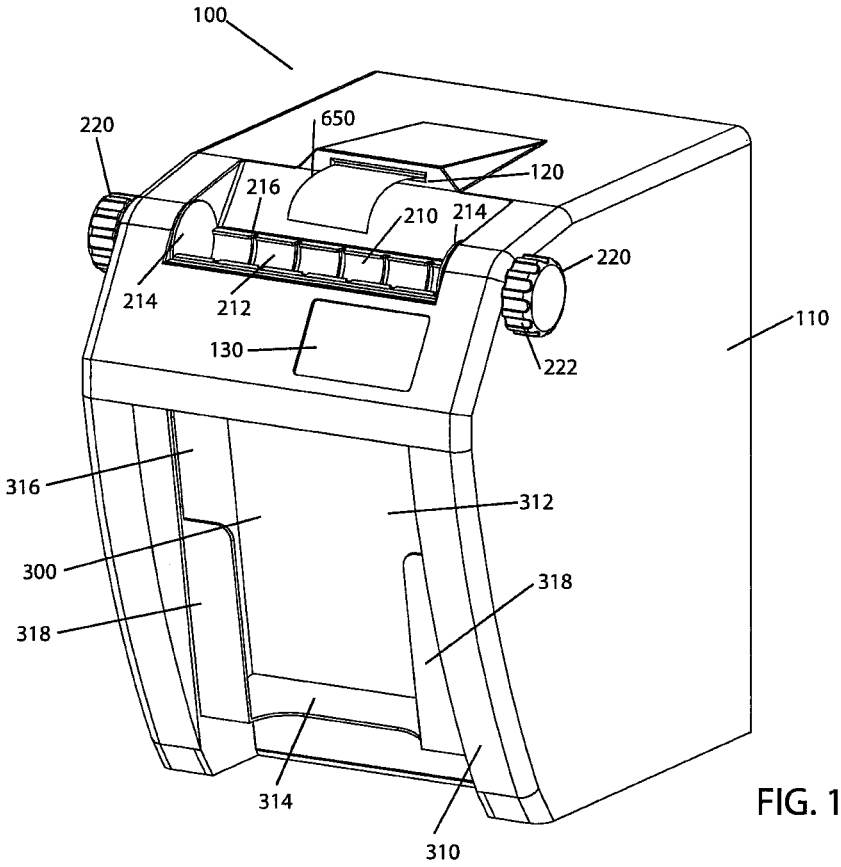
FIG. 1 illustrated a front elevation view of one non-limiting embodiment of the custom packaging center in accordance with the present invention.
Figure 3:
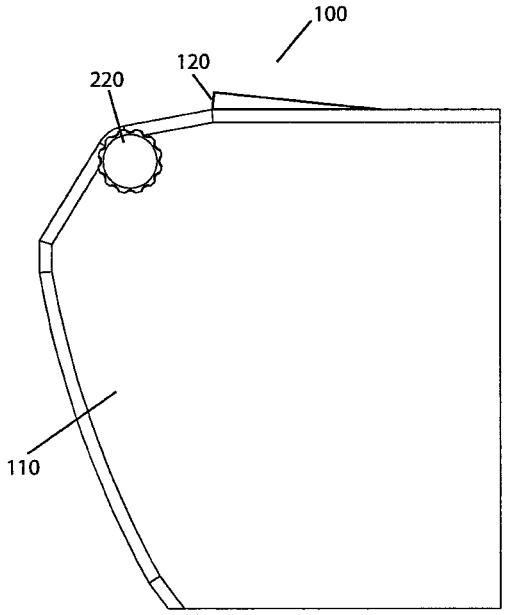
FIG. 3 is a side plan view of the custom packaging of FIG. 1.
Figure 2:
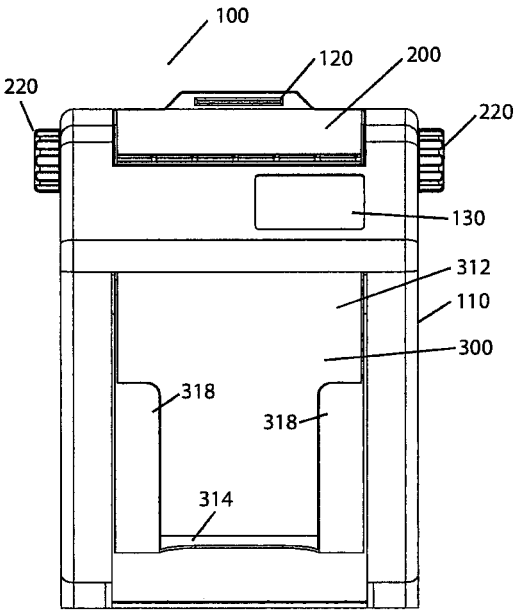
FIG. 2 is a front plan view of the custom packaging of FIG. 1.

Referring now to the drawings wherein the showing is for the purpose of illustrating non-limiting embodiments of the invention only and not for the purpose of limiting the same, as illustrated in FIGS. 1-11 there is illustrated a custom packaging center 100 that is designed to allow a customer to select several items of an item such as, but not limited to canned pet food, and to package the selected items in a single package.

Figure 9A:
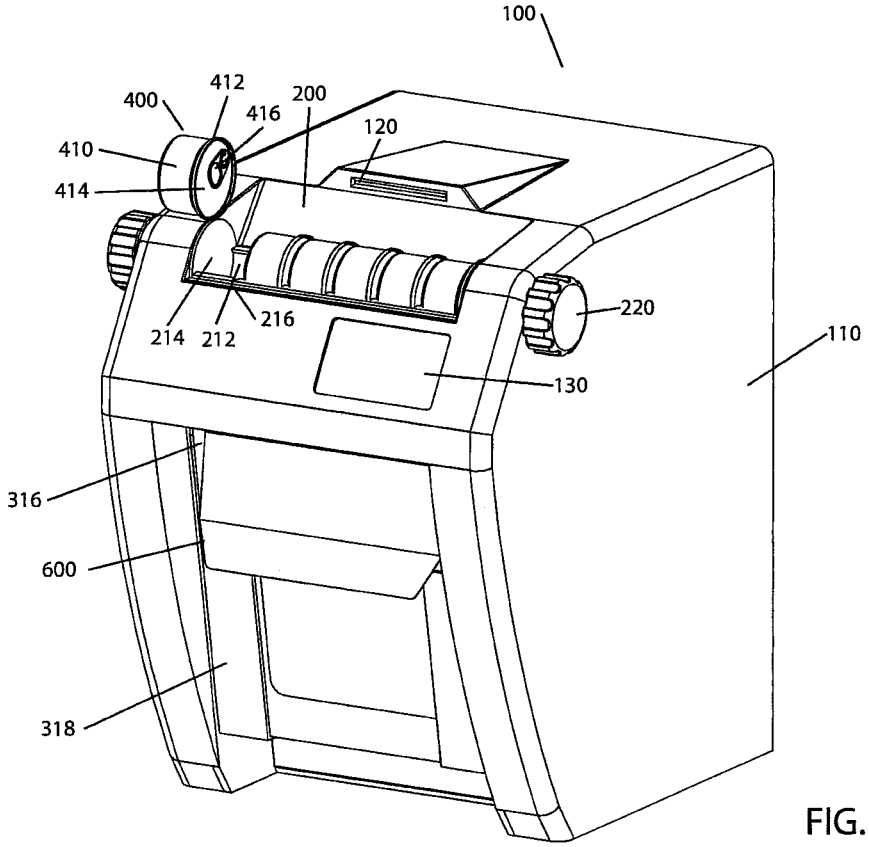
FIG. 9A is a front elevation view of the custom packaging center of FIG. 8 wherein the loading station is partially loaded with container.
Figure 9B:
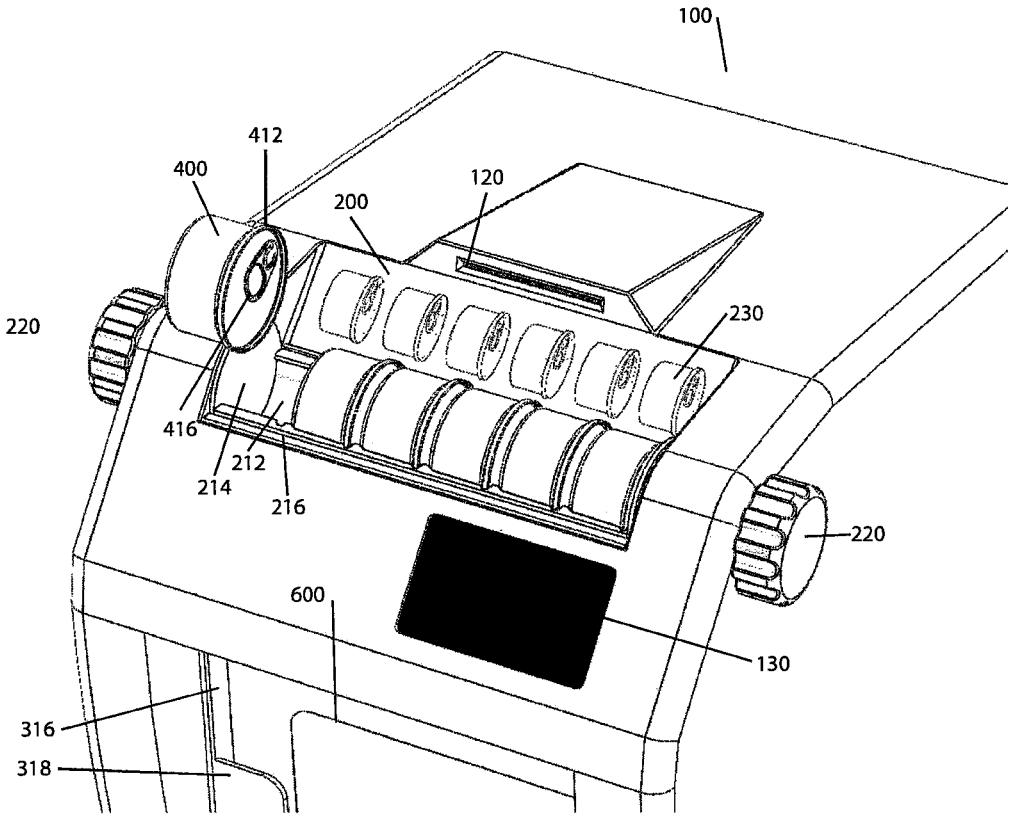
FIG. 9B is an enlarged top portion of the custom packaging center of FIG. 9.
Figure 10:
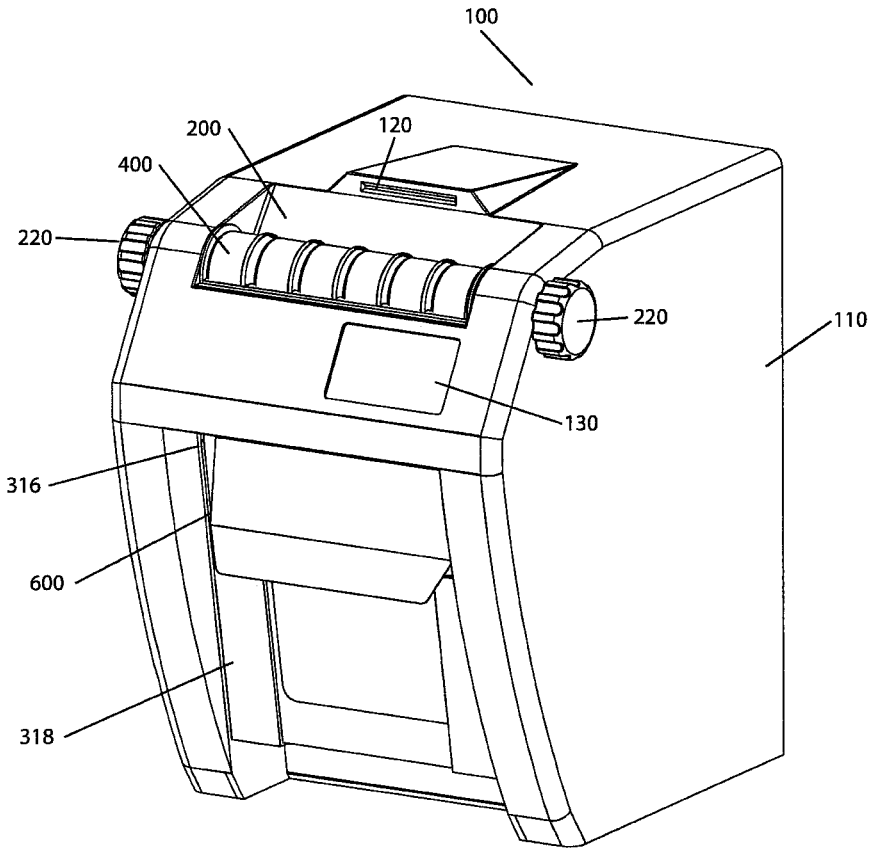
FIG. 10 is a front elevation view of the custom packaging center of FIG. 9 wherein the loading station is fully loaded with containers.

The custom packaging center 100 includes a housing 110, a loading station 200 and a packaging station 300. The loading station is illustrated as being positioned on the top front portion of the custom packaging center 100; however, this is not required. The loading station includes a loading tray 210 that is designed to receive a plurality of containers of a food item 400 as illustrated in FIGS. 9 and 10. As illustrated in FIG. 10, the loading tray is designed to hold up to six containers of a food item; however, it will be appreciated that the loading tray can be designed to hold more than or less than six containers of a food item. The body 212 of the loading station has a generally half-cylinder configuration; however, this is not required. Each end of body 212 includes a circular flange 214; however, this is not required. The body 212 optionally includes a plurality of slots 216 which can be used to orient the food item 400 in a certain manner on the body of the loading tray. As illustrated in FIGS. 9A and 9B, the food item is in the form of a container that include a container body 410 and a top flange 412. A removable lid 414 is optionally connected to the flange. The lid can optionally include a tab 416 that is used to facilitate in the removal of the lid from the flange. The flange is illustrated as having a larger radius than the container body; however, this is not required. For such a container arrangement, the slots 216 are designed to receive the flange of the container when the container is positioned in the loading tray. If the container is not properly placed in the loading tray, the container will not properly sit in the loading tray and the processing of the containers in the loading tray will not be able to continue; however, this is not required. FIG. 9B illustrated that an optional diagram 230 can be used to indicate the manner in which the container is to be loaded in the loading tray.

Figure 11:
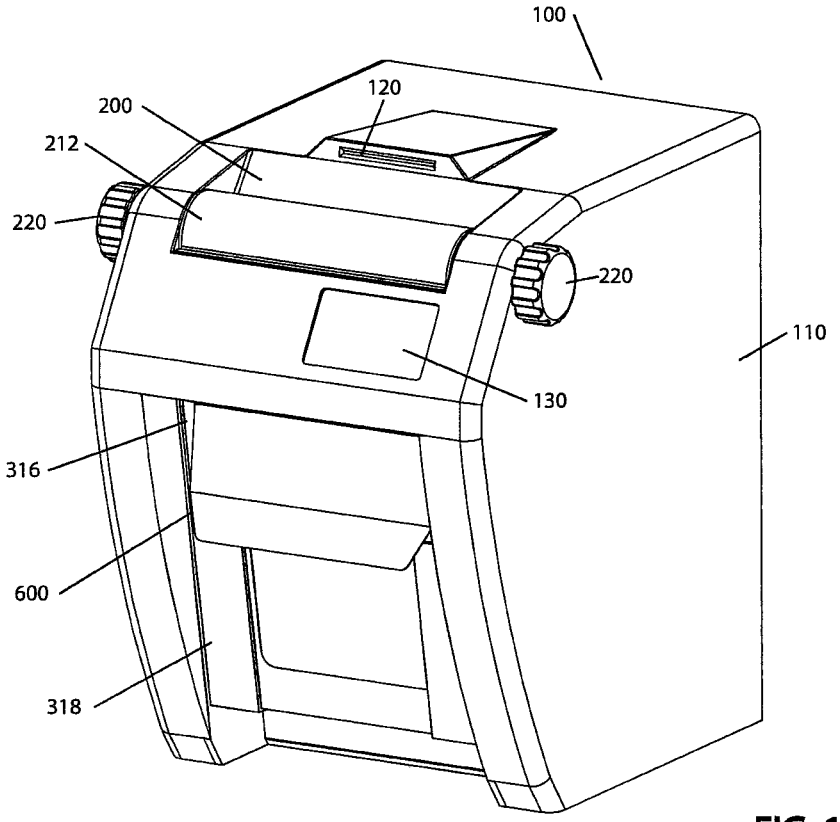
FIG. 11 is a front elevation view of the custom packaging center of FIG. 10 wherein the loading station is rotated to the non-load position.

The loading tray is designed to rotate about its longitudinal axis between a load position as illustrated in FIGS. 1, 2 and 4A-10 and a non-load position as illustrated in FIG. 11. The rotation of the loading tray can be done manually by a user or automatically by the custom packaging center. When the loading tray is manually rotated, the custom packaging center will generally include a lever, knob 220, or some other structure that will enable the user to rotate the loading tray. As illustrated in FIGS. 1-3 and 5-11, the sides of the housing includes two knobs 220 that allow the user to rotate the loading tray. The knob can optionally include grooves 222 to facilitate in the grasping and the turn of the knobs. When the loading tray is automatically rotated by the custom packaging center, the custom packaging center generally includes one or more motors (not shown) that are connected and/or interconnected to the loading tray to cause the loading tray to rotate.

Figure 5:
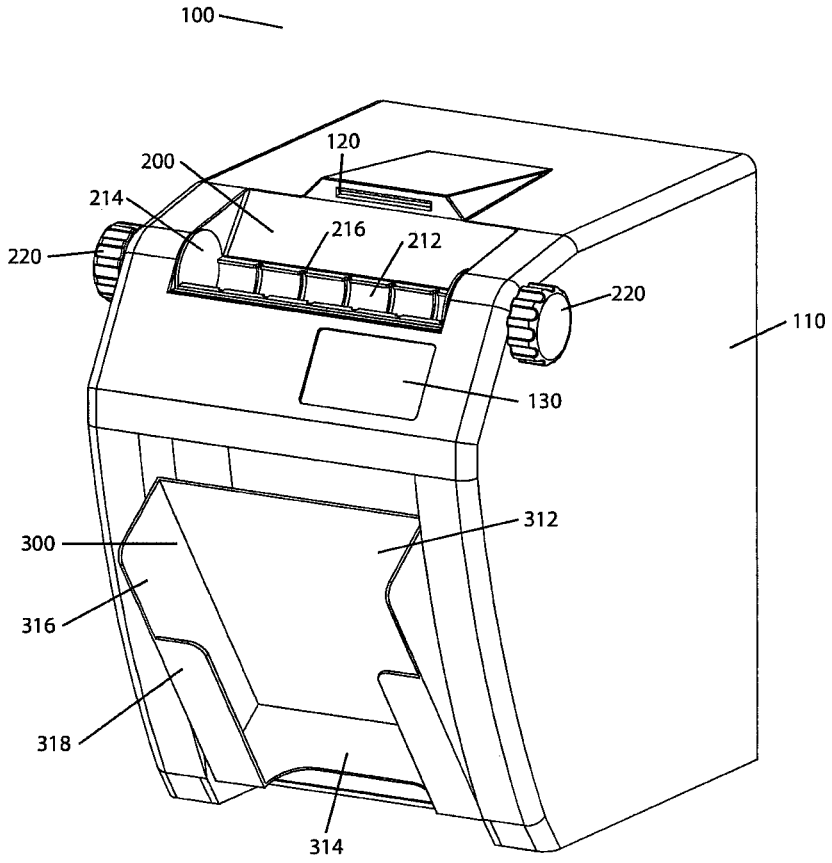
FIG. 5 is a front elevation view of the custom packaging center of FIG. 1 wherein the box tray is pivoted to the load/remove position.
Figure 6:
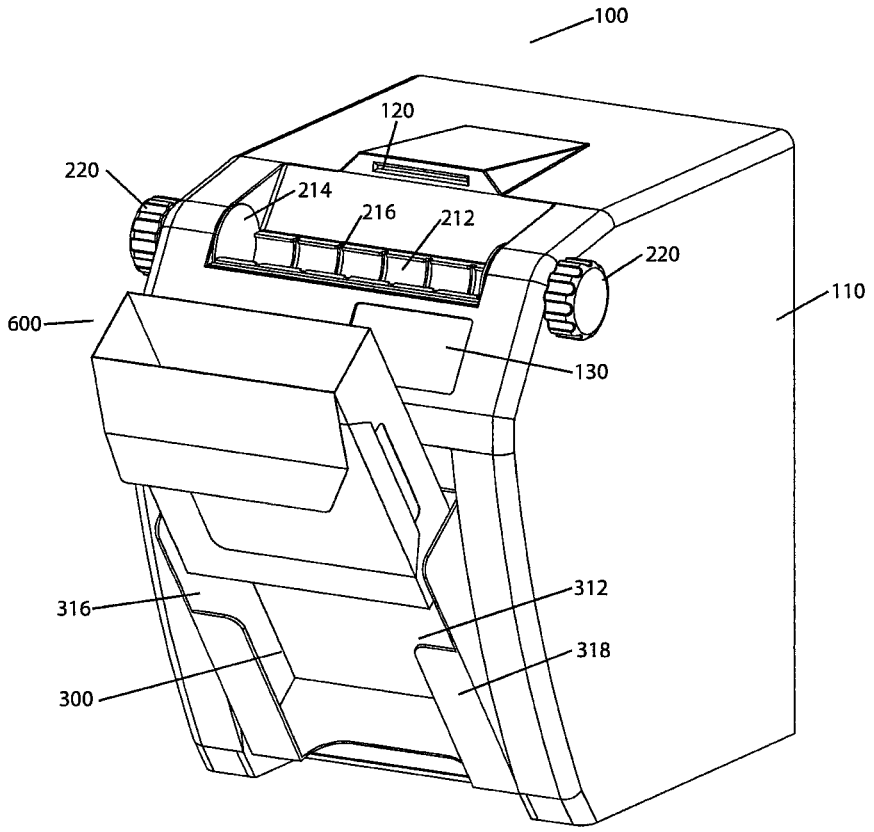
FIG. 6 is a front elevation view of the custom packaging center of FIG. 1 wherein the box tray is pivoted to the load/remove position and the packaging is being inserted into the box tray.
Figure 7:
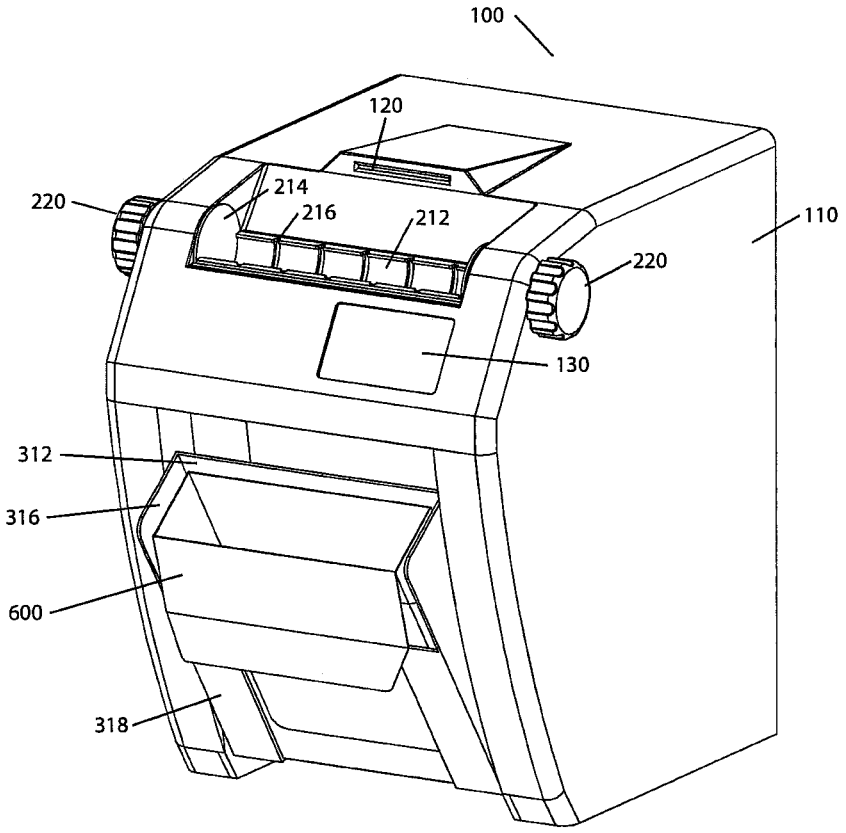
FIG. 7 is a front elevation view of the custom packaging center of FIG. 6 wherein the package is fully inserted into the box tray.
Figure 8:
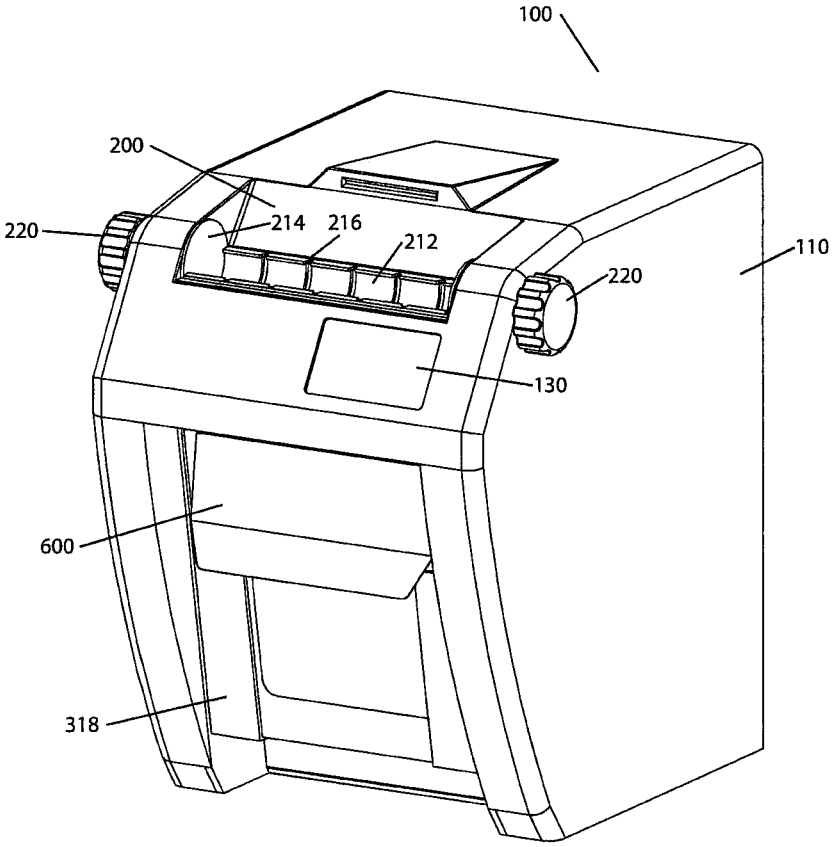
FIG. 8 is a front elevation view of the custom packaging center of FIG. 7 wherein the box tray is pivoted to the fill position and includes the packaging.

The packaging station 300 is illustrated as being positioned at the front of the custom packaging center and below the loading station; however, this is not required. The packaging station includes a box tray 310 that is pivotally connected to the housing so as to be able to pivot between a load/remove position as illustrated in FIGS. 5-7 and the fill position as illustrated in FIGS. 1, 2 and 4A, 8-11. The box tray includes a back face 312, a bottom flange 314, two side flanges 316 and two front flanges 318. The packaging 600 is designed to be inserted between the back face and front flanges and rest on the bottom flange as illustrated in FIGS. 6-11. When the box tray is in the load/remove position, the packaging 600 can be inserted into or removed from the box tray. When the box tray is positioned in the fill position, the packaging generally cannot be removed from the box tray; however, this is not required. The movement of the box tray between the load/remove position and the fill position can be done manually by the user or automatically be the custom packaging center. When the box tray is designed to be manually pivoted, the housing can include a lever, knob, or some other structure (not shown) that will enable the user to pivot the tray box between the load/remove position and the fill position. When the tray box is automatically pivoted between the load/remove position and the fill position by the custom packaging center, the custom packaging center generally includes one or more motors (not shown) that are connected and/or interconnected to the tray box to cause the tray box to pivot. The pivot box can be spring loaded to move to the tray box to the load/remove position or the fill position; however, this is not required.

Figure 4A:
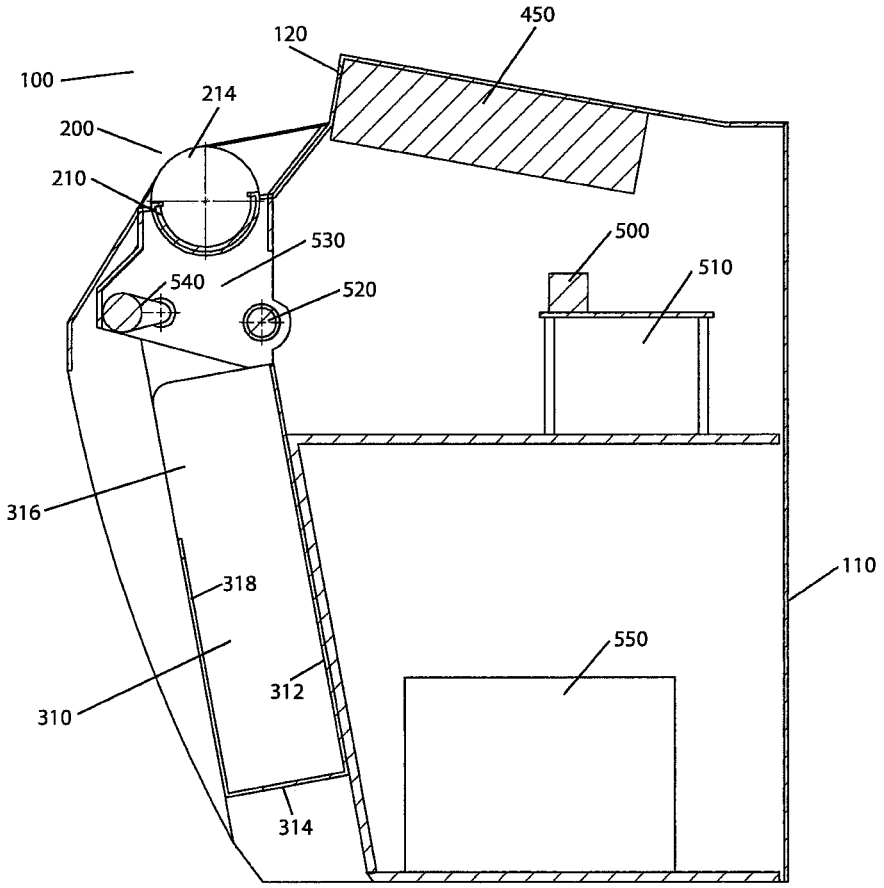
FIGS. 4A and 4B are cross-section views of the custom packaging of FIG. 3.
Figure 4B:
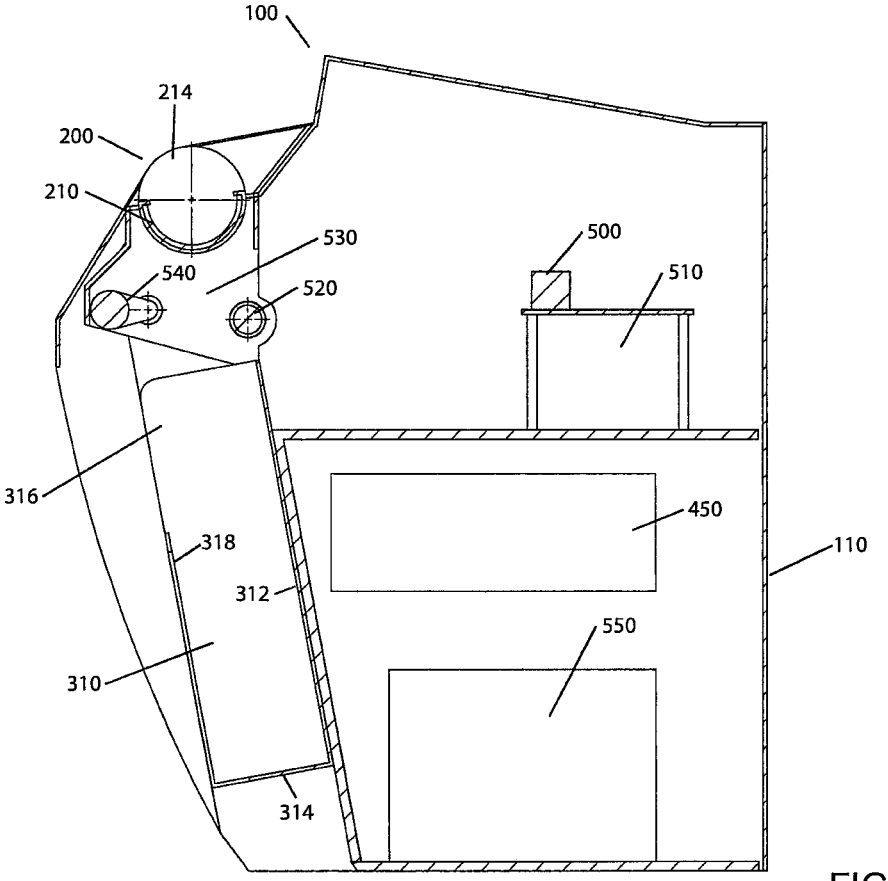

Referring again to FIGS. 1-11, the custom packaging center can optionally include a label opening 120 that is designed to dispense a printed label 650 from a printer 450 that is located in the interior of the custom packaging center as illustrated in FIG. 4A. FIG. 4B illustrates the printer 450 located in a different region of the interior of the custom packaging center. In this arrangement, the printer applies a label directly to the packaging or prints the information directly on the packaging. As can be appreciated, the printer can be located on the exterior of the housing of the custom packaging center. The location of the label opening on the housing of the custom packaging center and the location of the printer in the interior or exterior of the housing is non-limiting.

Referring again to FIGS. 1, 2 and 5-11, the custom packaging center optionally includes a display panel 130. The housing of the custom packaging center can include more than one display panel. The display panel can optionally function as a monitor and/or interactive screen. The display panel can be used to 1) provide information about the custom packaging center, 2) provide instructions on how to use the custom packaging center, 3) provide information about the products that have been loaded by the customer into the custom packaging center (e.g., flavor, nutritional value, recommended serving amounts, cost per ounce, etc.), 4) provide information about the pricing of the products that have been loaded by the customer into the custom packaging center, 5) provide status information to the customer during the loading process of the product into the packaging, 6) provide advertising about products, brands and/or store promotions, etc., 7) enable customer to select coupons, enter discount codes and/or scan coupons for products to be packaged by the custom packaging center, 8) provide information to guide the customer during the steps of use of the custom packaging center, 9) start the process for using the custom packaging center, 10) notify the customer that the products have been properly and/or improperly loaded in the loading station, 11) cause the loading station to rotate and/or the closing cover to close after product has been loaded into the loading station, 12) notify the customer that the packing process has been completed, 13) cause a label to be printed on a label and/or onto the packaging, 14) cancel the packaging process, 15) provide error information regarding the custom packaging center, 16) provide error information when the packaging receptacle is empty, 17) cause the box tray of the packaging station to open and/or close, 18) enable a user to obtain information about the food item (e.g., nutrition information, etc.), and/or 19) provide error information to a customer during the use of the custom packaging center. As can be appreciated, the display panel can have other or additional functions and/or uses. The display can be a color, monochrome or black and white display. The display may or may not be a touch screen display. The display can be designed to interact with other devices (e.g., smart phone, tablet, computer, etc.); however, this is not required. The location of the display on the housing is non-limiting.

Referring now to FIG. 4A, the custom packaging center includes an item identification arrangement which includes a product detector and/or scanner to identify the one or more products that were placed in the loading station. As illustrated in FIG. 4A, the product detector and/or scanner is in the form of a bar code scanner 500; however, it can be appreciated that other types of product detectors and/or scanners can be used. The product detector and/or scanner is generally connected to a computer or processor 510 that processes the scanned information. The scanned information can be used to generate a label that is printed by printer 450. Generally, the printer is connected or interconnected to the computer or processor 510; however, this is not required. Likewise, the display 130 is generally connected or interconnected to the computer or processor 510; however, this is not required. As can be appreciated, the computer or processor 510 can be used to partially or fully control the operation and/or electronic features of the custom packaging center; however, this is not required.

The item identification arrangement can optionally include a roller 520 that is designed to rotate food items 400 so that bar code scanner 500 can scan the bar code on the food items when the food items are located in the processing position. The roller is typically driven by an electric motor; however, the roller can be driven manually or by some other means.

The custom packaging center includes a product transport arrangement that is used to move and/or guide the food items that were loaded on the loading station to a processing position to be scanned by the scanner and then deposited in the packaging that is located in the tray box. As illustrated in FIG. 10, the body of loading tray 210 is fully filled with food items 400. Once the loading tray is properly and fully loaded, the loading tray is manually or automatically rotated about it longitudinal axis and causes the food items to drop into the scan zone 530 and partially rest on roller 520. Once the food items are contacting the roller, the roller can be caused to rotate, which in turn causes the food items to rotate to thereby allow the bar code scanner to scan the bar codes on the food items.

Once the scanning process is complete, the food items are allowed to drop into the open end of the packaging that is located beneath the scan zone. The food items can be caused to drop by a manual or automatic operation. As illustrated in FIG. 4A, a drop rod 540 is positioned adjacent to roller 520. The drop rod and roller are designed to support the food items in the scan zone during the scanning operation. After the scanning operation is complete, the drop rod is designed to move to allow the food items to drop from the scan zone and down toward the tray box. When packaging is located in the tray box, the food items drop into the opening of the packaging. The movement of the drop rod can be by a manual or automated operation. As can be appreciated, other or additional arrangements can be used to control the movement of the food items from the loading tray to the packaging.

The custom packaging center can include a battery and/or transformer 550 that is used to power the electronic components, motors, printers, display and other energy consuming components of the custom packaging center. When the custom packaging center includes a battery, the battery can be rechargeable; however, this is not required. As can be appreciated, the power source for the custom packaging center can be from a power outlet or other type of power source.

Figure 18:
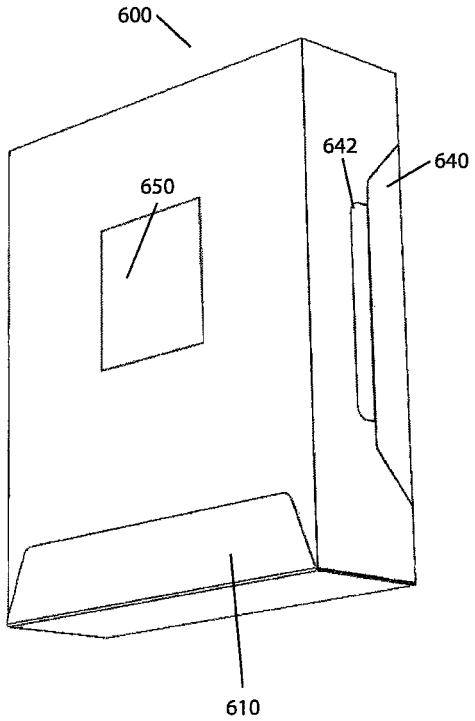
FIG. 18 is a front elevation view of the assembled and seal packaging.
Figure 19:
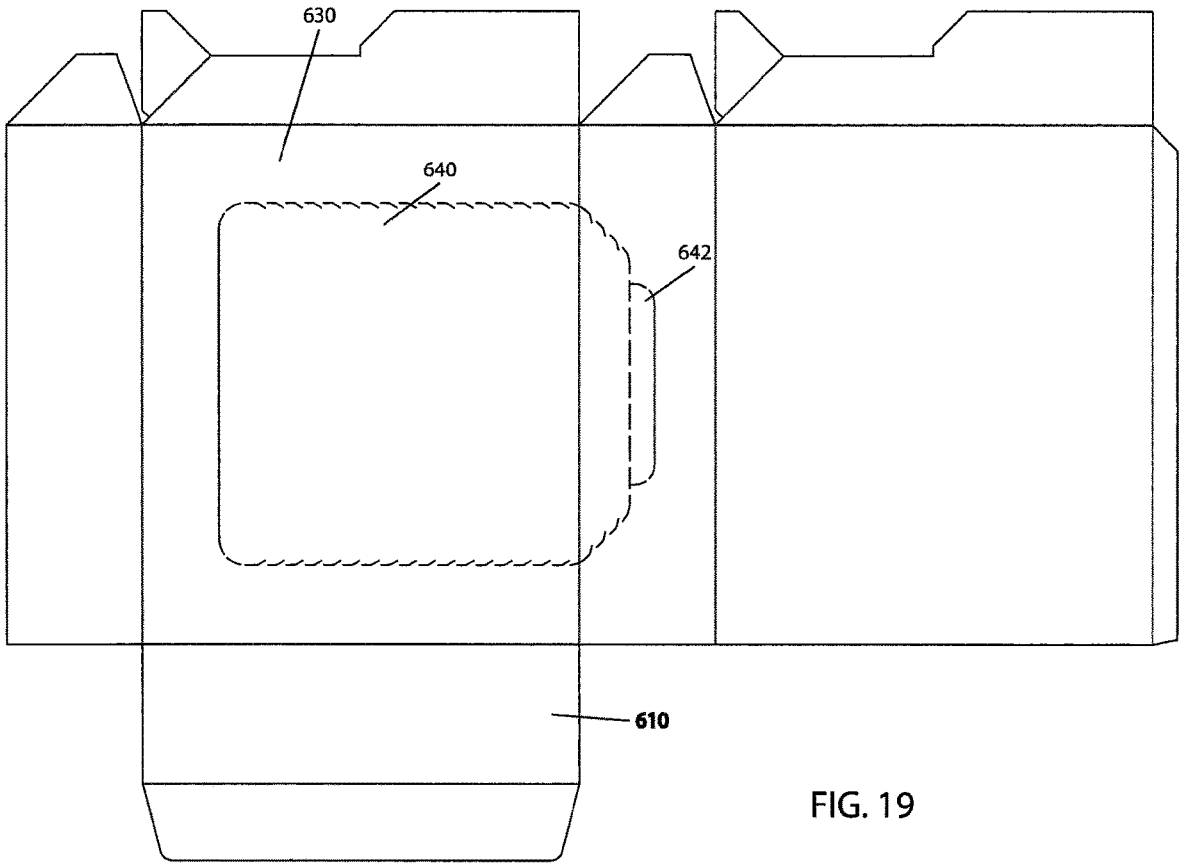
FIG. 19 is a top plan view of the non-folded packaging of FIG. 18.
Figure 20:
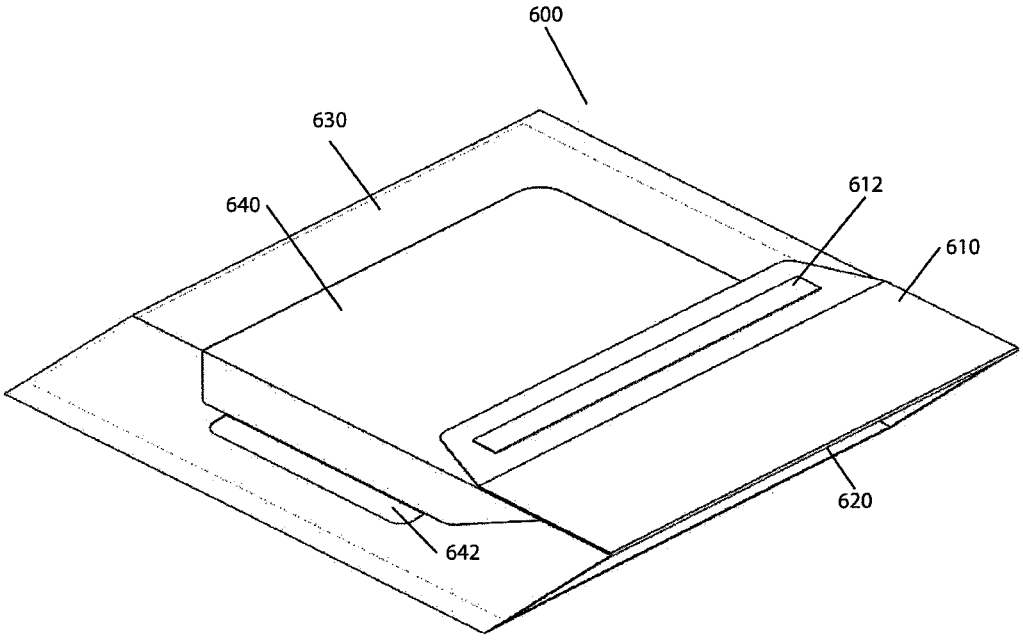
FIG. 20 is a front elevation view of the assembled, collapsed and non-sealed packaging of FIG. 18.
Figure 21:
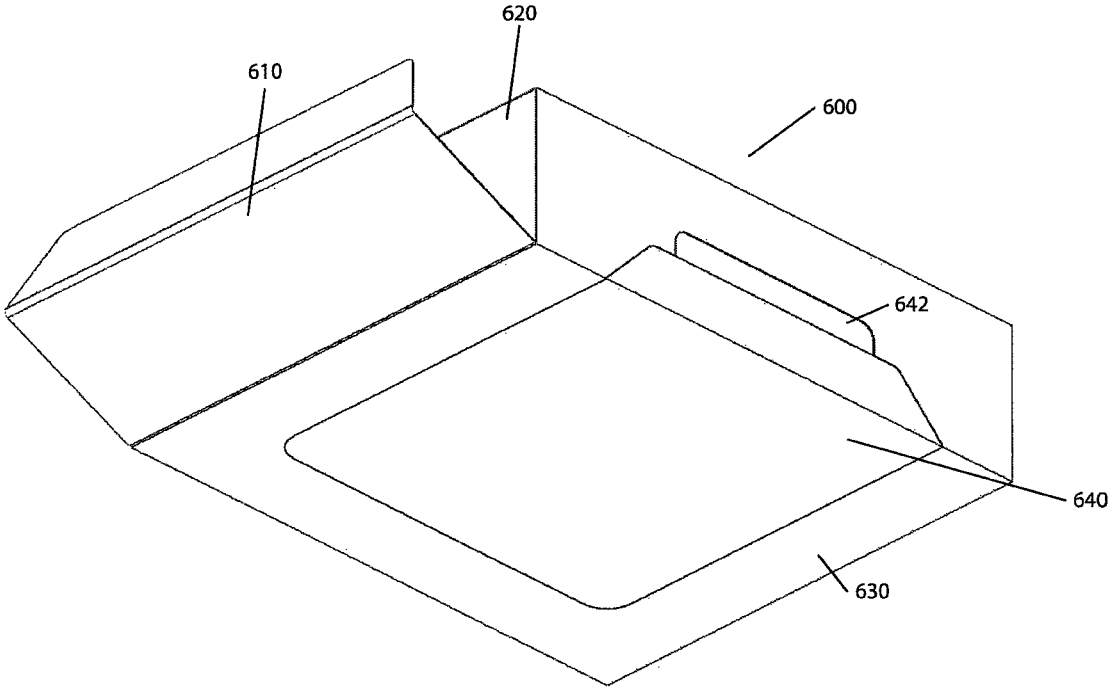
FIG. 21 is a front elevation view of the assembled and non-sealed packaging of FIG. 18.

Referring now to FIGS. 18-21, a non-limiting configuration of packaging 600 is illustrated. The packaging is generally formed of paper board and/or cardboard; however, other materials can be used. FIG. 18 illustrates the packaging in a fully assembled and sealed form. Generally, when the packaging is in this form, processed product is located in the packaging; however, this is not required. FIG. 19 illustrates the packaging in a flat, non-assembled form. The packaging can optionally include a sealable primary flap 610 that seals the opening 620 in the packaging once the food items have been loaded into the packaging. As illustrated in FIG. 20, the primary flap can include an adhesive strip 612 to form the seal; however, this is not required. The body 630 of the packaging can optionally include a serrated flap portion 640 that can be opened to provide access to the food items in the packaging without having to break the seal of the primary flap. The serrated flap portion can optionally include a pull tab 642 that can be grasped by the user to facilitate in the opening of the packaging via the serrated flap portion. As illustrated in FIG. 18, the packaging can include a label 650 that includes the information (e.g., bar code, printed item list, etc.) that is representative of the contents of the packaging. In one non-limiting arrangement, a bar code is printed on the label, which bar code can be scanned at checkout. The printed bar code provides information to the scanner at checkout of the contents of the packaging so that a complete package price for the package can be rung up and the contents of the packaging need not be individually scanned. The bar code can also be used by a store for inventory control since the single bar code will provide information to the store about each of the items in the packaging. As can be appreciated, the label can be manually or automatically applied to the packaging. As can also be appreciated, the bar code can be printed directly onto the packaging without use of a separate label.

Figure 12:
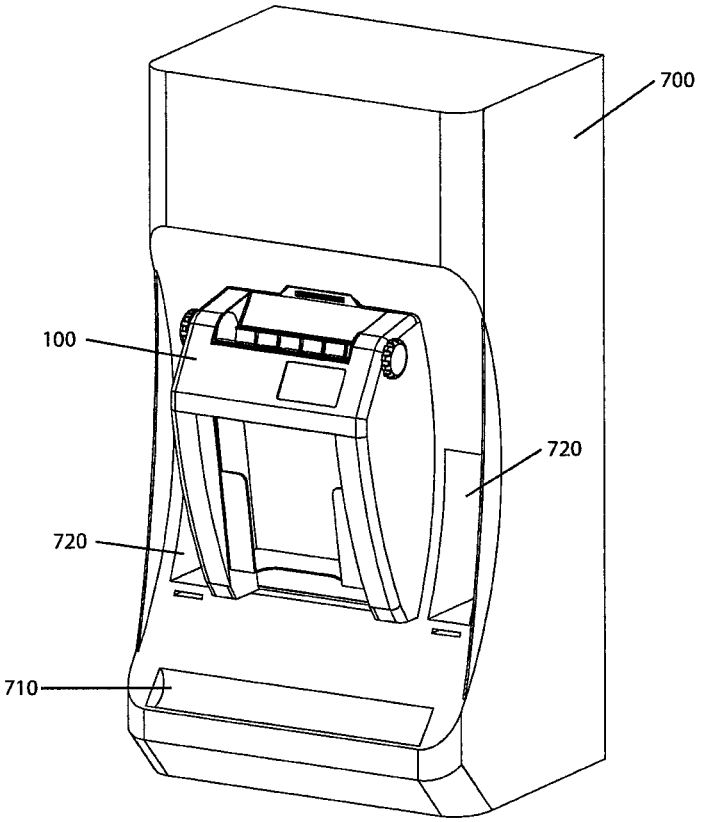
FIG. 12 is a front elevation view of the custom packaging center of FIG. 1 that is positioned in a stationary center housing.
Figure 14:
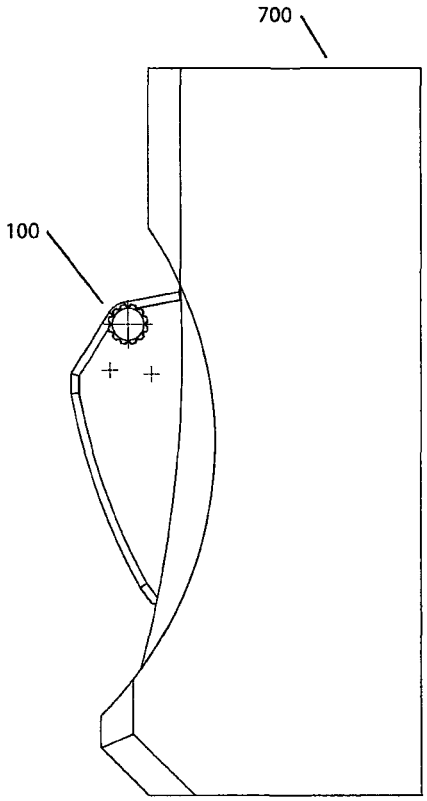
FIG. 14 is a side plan view of the custom packaging and stationary center housing of FIG. 12.
Figure 13:
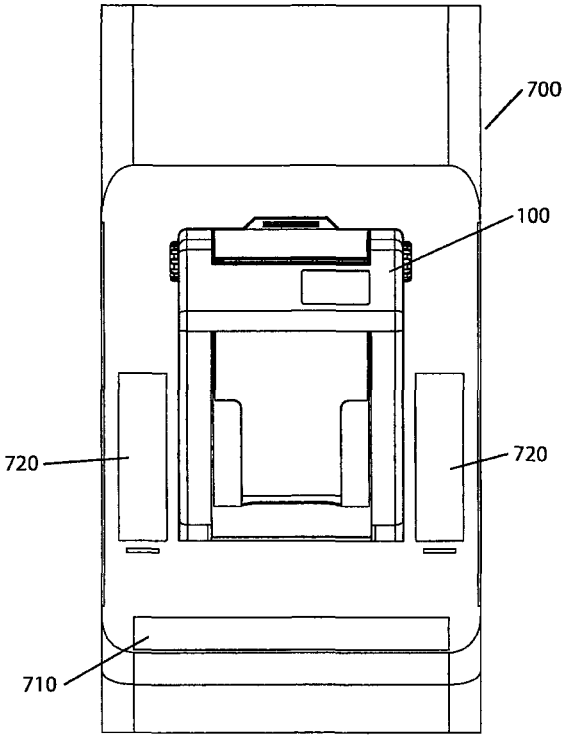
FIG. 13 is a front plan view of the custom packaging and stationary center housing of FIG. 12.
Figure 15:
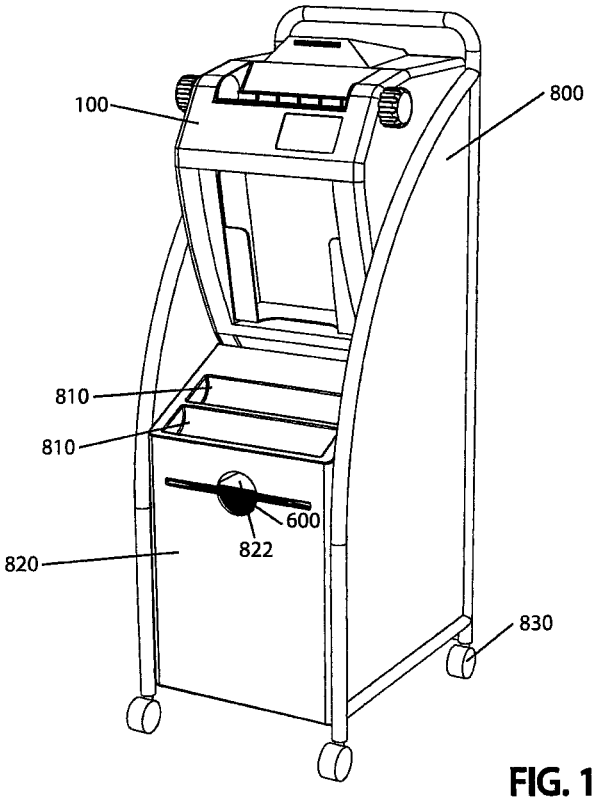
FIG. 15 is a front elevation view of the custom packaging center of FIG. 1 that is positioned in a mobile center housing.
Figure 17:
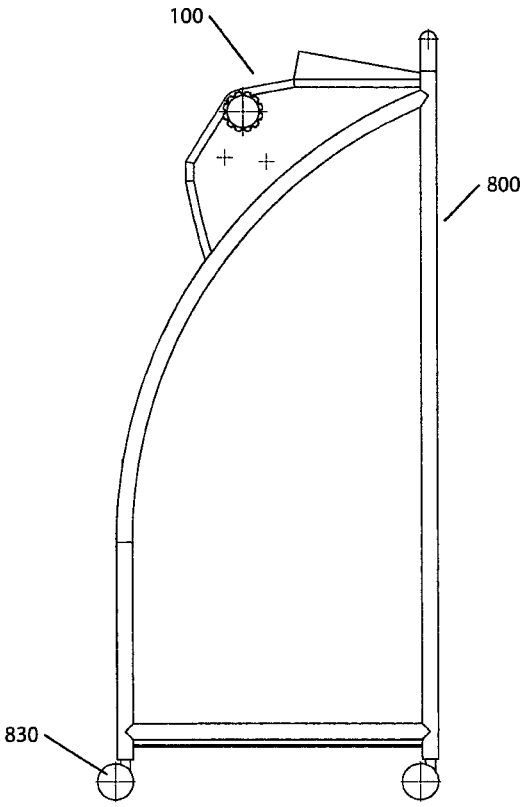
FIG. 17 is a side plan view of the custom packaging and mobile center housing of FIG. 15.
Figure 16:
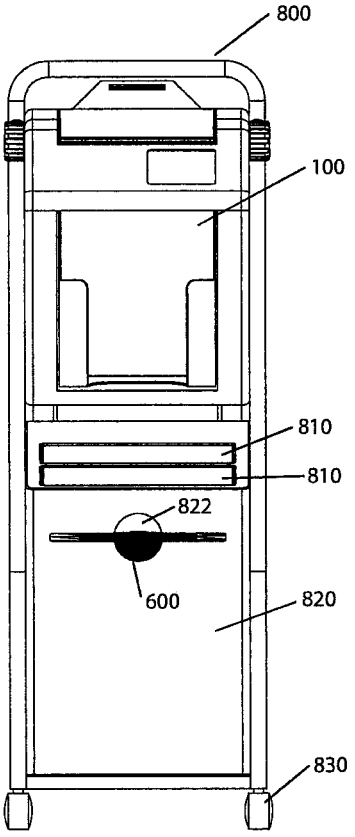
FIG. 16 is a front plan view of the custom packaging and mobile center housing of FIG. 15.

Referring now to FIGS. 12-17, the custom packaging center can be mounted or placed on a stationary center housing as illustrated in FIGS. 12-14 or on a mobile center housing as illustrated in FIGS. 15-17. The stationary center housing 700 is generally designed to be placed on a shelf or connected to the shelf that is near the food items that are be used with the custom packaging center. The mobile center station 800 is designed to provide mobility to the custom packaging center to allow the custom packaging center to be easily moved to various locations. The configuration of the stationary center housing and the mobile center housing is non-limiting. Both the stationary center housing and the mobile center housing illustrate the optional shelf system 710, 820 that can be used by the user to initially select and store food items prior to loading the food items in into the loading tray 210. The size, shape and configuration of the shelf system and location of the shelf system on the stationary center housing and the mobile center housing is non-limiting, when used, are non-limiting. The stationary center housing is illustrated as including one or more packaging slots 720 that can be used to store the folded packaging 600. The mobile center housing is illustrated as having an optional packaging bin 820 wherein folded packaging 600 can be stored. The packaging bin can include a bin opening 822 to enable packaging to be removed from the packaging bin; however, it can be appreciated that the packaging bin can include a door or other type of access to enable a user to remove the packaging from the packaging bin. The mobile center housing is illustrated as including one or more rollers or wheels 830 to facilitate in the mobility of the mobile center housing.

Figure 22A:
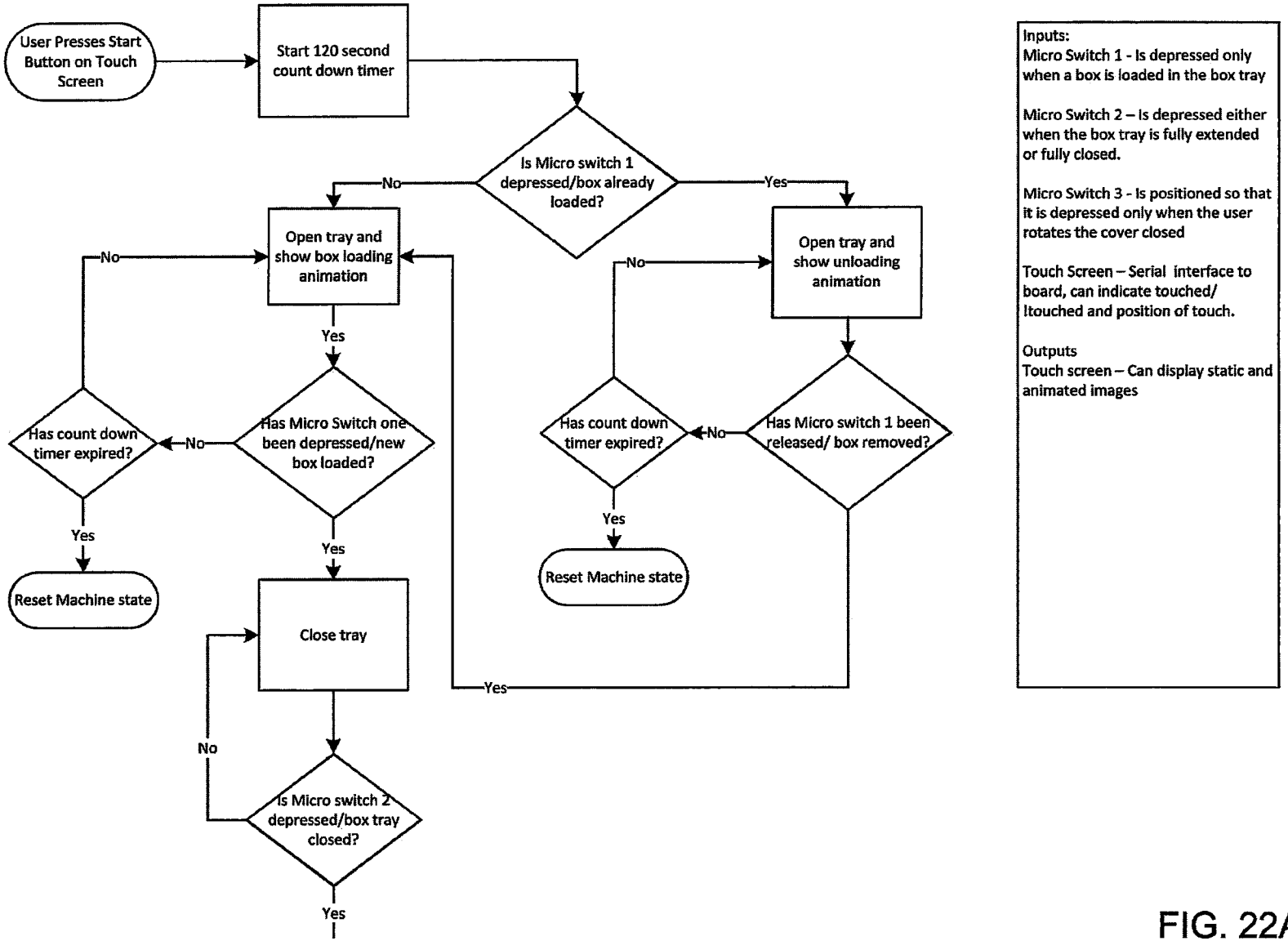
FIG. 22A is the top half of a logic diagram of a non-limiting operation of the custom packaging center in accordance with the present invention.
Figure 22B:
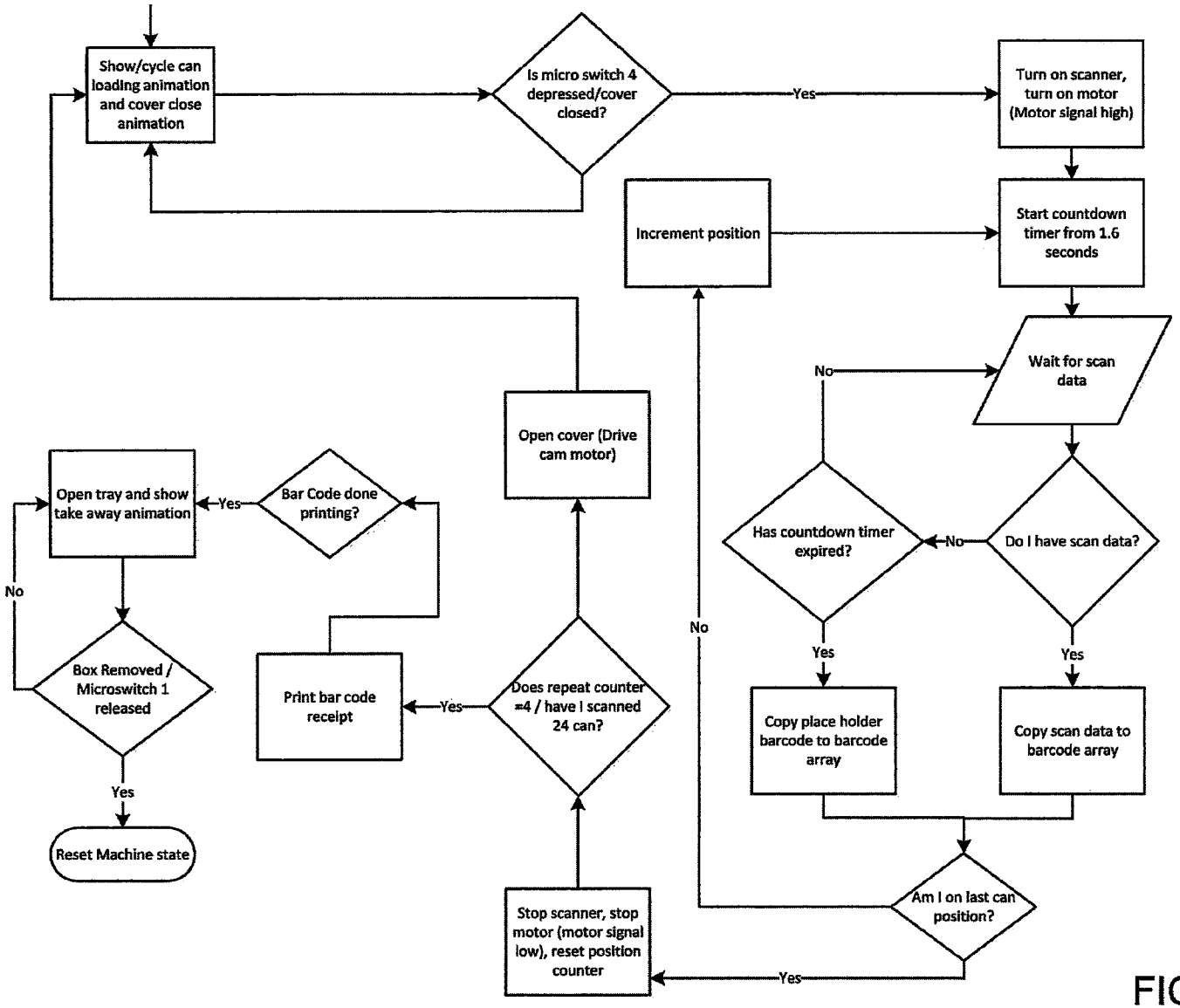
FIG. 22B is the bottom half of a logic diagram of a non-limiting operation of the custom packaging center in accordance with the present invention.

Referring now to FIGS. 22A and 22B, a process flow chart that set forth one non-limiting way in which the custom packaging center can be used is illustrated. As illustrated in the process flow chart, the custom packaging center can include one or more sensors to sense 1) when packaging is loaded into the box tray, 2) when the box tray is in the load/remove position and/or the fill position, and/or 3) when the loading tray has been rotated to cause the food item to move to the processing position. As can be appreciated, other or additional sensors can be used (e.g., sensor to verify the loading tray is properly and/or fully loaded, sensor to detect whether the packaging is partially or fully filled, sensor to verify the packaging is properly positioned in the box tray, sensor to detect whether food items are located in the processing position and/or properly located in the processing position, sensor to verify the food items are being rotated by the roller, sensor to detect whether there is power or proper power to the custom packaging center, sensor to detect if the food items have been properly or fully moved from the processing position to the packaging, sensor to detect if printer labels need to be replaced, sensor to detect if printer ink for printer needs to be replaced, sensor to detect if the printer is properly functioning, sensor to detect if scanner is properly functioning, sensor to detect if display is properly functioning, etc.).

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

We claim:

1. A method for creating a customized package of a plurality of food items comprising:

a. providing an automated custom packaging center that includes a loading station, an automated packaging station and an automated identification arrangement, the loading station selectively positionable between a loading position and a processing position, the loading position to receive the plurality of food items, the automated identification arrangement comprising a bar code scanner and a scan zone to identify each of the plurality of food items loaded into the loading station by scanning each of the plurality of food items using the bar code scanner when each of the plurality food items is positioned in the processing position of the loading station and within the scan zone, the automated identification arrangement further comprising a processor configured to create an identification code that identifies each of the plurality of food items loaded in the loading station, the automated packaging station configured to support a removable packaging and to position the removable packaging to receive the plurality of food items when the plurality of food items are directed from the loading station and after the automated identification arrangement has identified each of the plurality of food items loaded into the loading station;

b. loading the plurality of food items into the loading station;

c. moving the plurality of food items to the processing position by repositioning the loading station from the loading position;

d. identifying each of the plurality of food items using the bar code scanner;

e. loading each of the plurality of food items into the removable packaging positioned within the automated packaging station by directing each of the plurality of food items from the loading station; and f. generating the identification code that identifies each of the plurality of food items loaded in the loading station;

wherein the plurality of food items are selected from the group consisting of cans, containers, pet food, canned soup, soup containers, canned meat, meat containers, canned seafood, seafood containers, canned fruit, fruit containers, canned vegetables, vegetable containers, containers of sauces, containers of mints/breath fresheners, containers of gum, containers of candy, beverage containers, spice containers, frozen beverage concentrates containers, containers of yogurt, containers of refrigerated goods, and containers of frozen goods, wherein a bottom flange, a top flange, and a back surface of the automated packaging station define a tray box, the tray box movable between a load/remove position and a fill position, the tray box in the load/remove position is configured to enable the removable packaging to be inserted into the tray box, removed from the tray box, or combinations thereof, wherein the tray box in the fill position is configured to position the removable packaging to receive the plurality of food items after the automated identification arrangement has identified at least one of the plurality of food items.

2. The method as defined in claim 1, further including the step of printing the identification code on at least one medium selected from the group consisting of a label and the removable packaging.

3. The method as defined in claim 2, wherein the automated custom packaging center includes a label dispenser configured to dispense a label printed by a printer, and the method comprises securing the label to the removable packaging.

4. The method as defined in claim 1, wherein the automated identification arrangement includes a rotating mechanism configured for repositioning at least one of the plurality of food items to facilitate in the identification of each of the plurality of food items.

5. The method as defined in claim 1, wherein the automated custom packaging center includes a display screen, the display screen configured to perform one or more actions selected from the group consisting of 1) providing information about the automated custom packaging center, 2) providing instructions on how to use the automated custom packaging center, 3) providing information about the plurality of food items, 4) providing information about pricing of the plurality of food items, 5) providing status information as to the operation of the automated custom packaging center, 6) providing advertising about the plurality of food items, related food items, brands, store promotions, or combinations thereof, 7) enabling a selection of coupons, 8) enabling entry of discount codes, 9) enabling scanning of coupons, promotion codes, or combinations thereof, 10) providing information as to steps of use for the automated custom packaging center, 11) starting a process for using the automated custom packaging center, 12) providing notification that the plurality of food items have been properly loaded, improperly loaded, or combinations thereof in the loading station, 13) causing the loading station to rotate, closing a cover over the loading station, or combinations thereof after the plurality of food items have been loaded in the loading station, 14) providing notice that a packing process of the plurality of food items has been completed, 15) causing the identification code to be printed on a label, 16) causing the identification code to be printed on the removable packaging, 17) canceling a packaging process, 18) providing error information regarding the automated custom packaging center, 19) providing error information when a packaging receptacle is empty, and 20) causing a box tray of the automated packaging station to open, close or combinations thereof.

6. The method as defined in claim 1, wherein the automated custom packaging center is positioned on or integrated with a shelf system.

7. The method as defined in claim 1, wherein the automated custom packaging center is a free-standing self-contained system.

8. A method for creating a customized package of a plurality of food items comprising:

a. providing an automated custom packaging center that includes a loading station, an automated packaging station and an automated identification arrangement, the loading station selectively positionable between a loading position and a processing position, the loading position to receive the plurality of food items, the automated identification arrangement comprising a bar code scanner and a scan zone to identify each of the plurality of food items loaded into the loading station by scanning each of the plurality of food items using the bar code scanner when each of the plurality food items is positioned in the processing position of the loading station and within the scan zone, the automated identification arrangement further comprising a processor configured to create an identification code that is representative of the identification of each of the plurality of food items loaded in the loading station, the automated packaging station configured to support a removable packaging and to position the removable packaging to receive the plurality of food items when the plurality of food items are directed from the loading station and after the automated identification arrangement has identified each of the plurality of food items loaded into the loading station;

b. loading the plurality of food items into the loading station;

c. moving the plurality of food items to the processing position by repositioning the loading station from the loading position;

d. identifying each of the plurality of food items using the bar code scanner;

e. loading each of the plurality of food items into the removable packaging positioned within the automated packaging station by directing each of the plurality of food items from the loading station; and f. generating the identification code;

wherein the plurality of food items are selected from the group consisting of cans, containers, pet food, canned soup, soup containers, canned meat, meat containers, canned seafood, seafood containers, canned fruit, fruit containers, canned vegetables, vegetable containers, containers of sauces, containers of mints/breath fresheners, containers of gum, containers of candy, beverage containers, spice containers, frozen beverage concentrates containers, containers of yogurt, containers of refrigerated goods, and containers of frozen goods, wherein a bottom flange, a top flange, and a back surface of the automated packaging station define a tray box, the tray box movable between a load/remove position and a fill position, the tray box in the load/remove position is configured to enable the removable packaging to be inserted into the tray box, removed from the tray box, or combinations thereof, wherein the tray box in the fill position is configured to position the removable packaging to receive the plurality of food items after the automated identification arrangement has identified at least one of the plurality of food items.

9. The method as defined in claim 8, further including the step of printing the identification code on at least one medium selected from the group consisting of a label and the removable packaging.

10. The method as defined in claim 9, wherein the automated custom packaging center includes a label dispenser configured to dispense a label printed by a printer, and the method comprises securing the label to the removable packaging.

11. The method as defined in claim 8, wherein the automated identification arrangement includes a rotating mechanism configured for repositioning at least one of the plurality of food items to facilitate in the identification of each of the plurality of food items.

12. The method as defined in claim 8, wherein the automated custom packaging center includes a display screen, the display screen configured to perform one or more actions selected from the group consisting of 1) providing information about the automated custom packaging center, 2) providing instructions on how to use the automated custom packaging center, 3) providing information about the plurality of food items, 4) providing information about pricing of the plurality of food items, 5) providing status information as to the operation of the automated custom packaging center, 6) providing advertising about the plurality of food items, related food items, brands, store promotions, or combinations thereof, 7) enabling a selection of coupons, 8) enabling entry of discount codes, 9) enabling scanning of coupons, promotion codes, or combinations thereof, 10) providing information as to steps of use for the automated custom packaging center, 11) starting a process for using the automated custom packaging center, 12) providing notification that the plurality of food items have been properly loaded, improperly loaded, or combinations thereof in the loading station, 13) causing the loading station to rotate, closing a cover over the loading station, or combinations thereof after the plurality of food items have been loaded in the loading station, 14) providing notice that a packing process of the plurality of food items has been completed, 15) causing the identification code to be printed on a label, 16) causing the identification code to be printed on the removable packaging, 17) canceling a packaging process, 18) providing error information regarding the automated custom packaging center, 19) providing error information when a packaging receptacle is empty, and 20) causing a box tray of the automated packaging station to open, close or combinations thereof.

13. The method as defined in claim 8, wherein the automated custom packaging center is positioned on or integrated with a shelf system.

14. The method as defined in claim 8, wherein the automated custom packaging center is a free-standing self-contained system.

* * * * *